US008121318B1

(12) United States Patent
Ambourn et al.

(10) Patent No.: US 8,121,318 B1
(45) Date of Patent: Feb. 21, 2012

(54) TWO CHANNEL AUDIO SURROUND SOUND CIRCUIT WITH AUTOMATIC LEVEL CONTROL

(76) Inventors: Paul R. Ambourn, Superior, WI (US); Earl J. Slafon, Superior, WI (US)

( * ) Notice: Subject to any disclaimer, the term of this patent is extended or adjusted under 35 U.S.C. 154(b) by 958 days.

(21) Appl. No.: 12/117,154

(22) Filed: May 8, 2008

(51) Int. Cl.
*H04R 5/02* (2006.01)
*H04R 5/00* (2006.01)

(52) U.S. Cl. ..... 381/307; 361/17; 361/18; 361/74; 361/310; 361/120

(58) Field of Classification Search ..... 381/307, 381/58, 59, 17, 300, 74, 101, 102, 103, 310, 381/309, 18, 120, 1
See application file for complete search history.

(56) References Cited

U.S. PATENT DOCUMENTS 4,479,235 A * 10/1984 Griffis ..... 381/17
4,495,637 A 1/1985 Bruney
4,536,716 A * 8/1985 Yoshida et al. ..... 330/69
4,748,669 A 5/1988 Klayman
4,908,858 A * 3/1990 Ohno ..... 381/1
5,420,929 A 5/1995 Geddes et al.
5,434,921 A 7/1995 Dombrowski, Jr. et al.
5,692,050 A * 11/1997 Hawks ..... 381/1
5,748,745 A * 5/1998 Bedini ..... 381/1
5,812,683 A * 9/1998 Parker et al. ..... 381/74
5,850,454 A * 12/1998 Hawks ..... 381/1
RE37,223 E * 6/2001 Bose et al. ..... 381/102
6,925,184 B2 * 8/2005 Wang ..... 381/18
7,564,982 B1 * 7/2009 Ambourn ..... 381/120
7,623,669 B2 * 11/2009 Ambourn ..... 381/120
2006/0215848 A1 9/2006 Ambourn
2010/0098259 A1 * 4/2010 Klayman ..... 381/1

* cited by examiner

*Primary Examiner* — Edgardo San Martin
(74) *Attorney, Agent, or Firm* — Donald J. Ersler

(57) ABSTRACT

The two channel audio surround sound circuit with automatic level control includes a right amplifier, a left amplifier, a right automatic level control and a left automatic level control. A right input is coupled to a positive input of the left amplifier through the right automatic gain control. The right input is coupled to a negative input of the right amplifier and coupled to the output of the right amplifier with one resistor. A left input is coupled to a positive input of the right amplifier through the left automatic gain control. The left input is coupled to a negative input of the left amplifier and coupled to the output of the left amplifier with another resistor.

13 Claims, 1 Drawing Sheet

TWO CHANNEL AUDIO SURROUND SOUND CIRCUIT WITH AUTOMATIC LEVEL CONTROL

BACKGROUND OF THE INVENTION

1. Field of the Invention

The present invention relates generally to surround sound processors and more specifically to a two channel audio surround sound circuit with automatic level control, which is less complicated than that of the prior art.

2. Discussion of the Prior Art

Surround sound processors are normally used to decode surround sound audio signals, which are recorded on the sound tracks of video cassettes and discs. Surround sound processors will also enhance the imaging of audio recordings. However, these surround sound processors use complicated circuitry to create a three dimensional sound field using as many as five speakers. The five speakers create a three dimensional sound field similar to that found in a modern movie theater.

U.S. Pat. No. 4,495,637 to Bruney discloses an apparatus and method for enhanced psychoacoustic imagery using asymmetric cross-channel feed. The Bruney patent includes asymmetric bi-directional audio signal cross-feed established between first and second audio sign processing channels. U.S. Pat. No. 4,748,669 to Klayman discloses a stereo enhancement system. The Klayman patent includes a stereo enhancement system which provides an enhanced wider stereo image and a wider listening area, and further provides perspective correction for achieving correct stereo sound perspective with speakers at different locations and with headphones.

U.S. Pat. No. 5,420,929 to Geddes et al. discloses a signal processor for sound image enhancement. The Geddes et al. patent includes providing fluctuating coherence between the left channel and right channel outputs by crossfeeding a high pass portion of the left channel to the right output and like portion of the right channel to the left output. U.S. Pat. No. 5,434,921 to Dombrowski, Jr. et al. discloses a stereo image control circuit. The Dombrowski, Jr. patent includes a stereo circuit which ranges between a mono mode through a stereo mode to a wide mode.

Patent application no. 2006/0215848 to Ambourn discloses a simplified amplifier providing sharing of music with enhanced spatial presence through multiple headphone jacks. The Ambourn patent includes a personal listening device used in connection with the amplification of signals for enhancing the perceived quality and ambiance of sound heard by a listener using stereo headphones or small speakers.

Accordingly, there is a clearly felt need in the art for a two channel audio surround sound circuit with automatic level control, which provides improved imaging and has a less complicated design than that of the prior art.

SUMMARY OF THE INVENTION

The present invention provides a two channel audio surround sound circuit with automatic level control, which is less complicated than that of the prior art. The two channel audio surround sound circuit with automatic level control (surround sound circuit) includes a right amplifier, a left amplifier, a right automatic level control and a left automatic level control. A right input is coupled to a positive input of the left amplifier through the right automatic gain control. The right input is coupled to a negative input of the right amplifier and coupled to the output of the right amplifier through one resistor. A left input is coupled to a positive input of the right amplifier through the left automatic gain control. The left input is coupled to a negative input of the left amplifier and coupled to the output of the left amplifier through another resistor.

Accordingly, it is an object of the present invention to provide a surround sound circuit that provides improved imaging.

Finally, it is another object of the present invention to provide a surround sound circuit, which has a less complicated design than that of the prior art.

These and additional objects, advantages, features and benefits of the present invention will become apparent from the following specification.

DETAILED DESCRIPTION OF THE PREFERRED EMBODIMENTS

Figure 1:
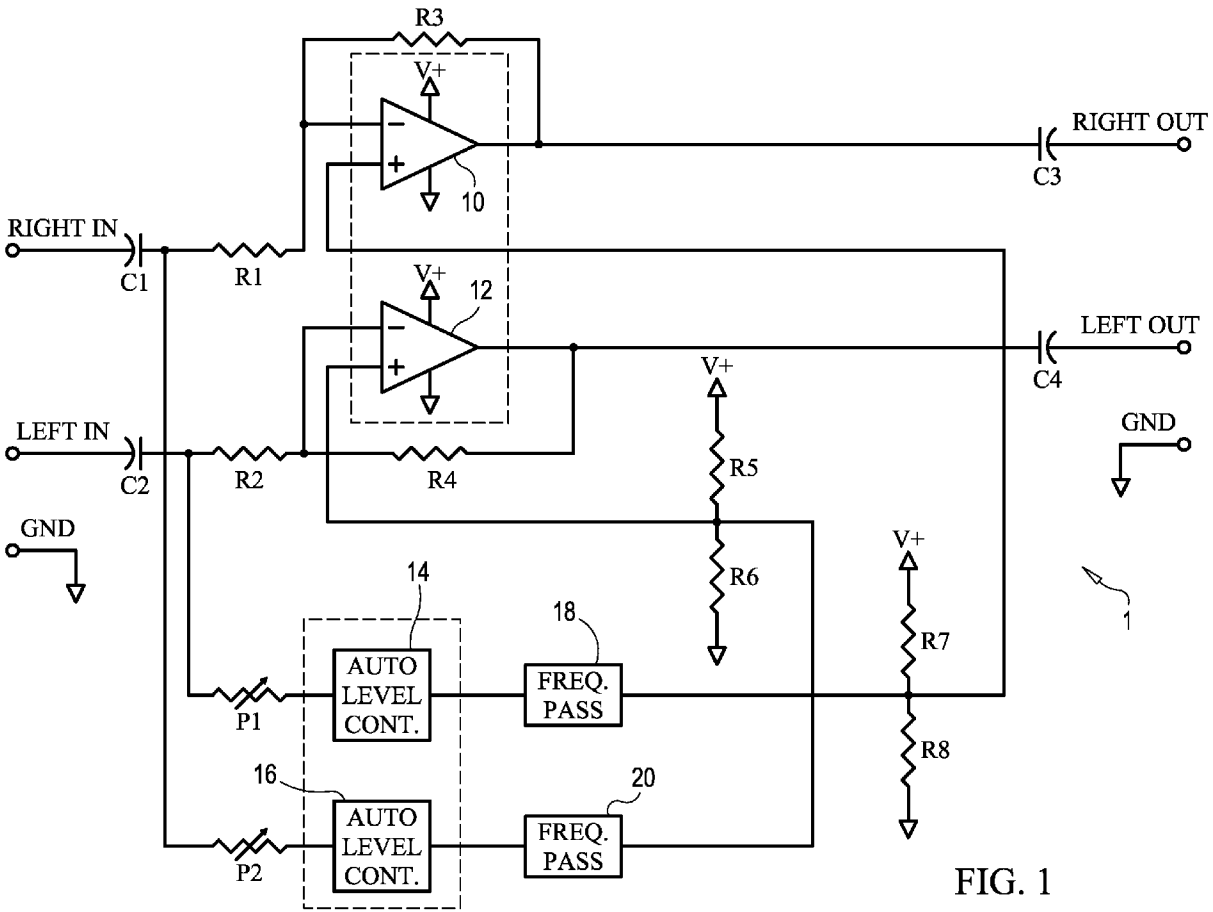
FIG. 1 is a surround sound circuit in accordance with the present invention.

With reference now to the drawings, and particularly to FIG. 1, there is shown a surround sound circuit 1. The surround sound circuit 1 includes a right amplifier 10, a left amplifier 12, a left automatic level control 14 and a right automatic level control 16. A right input line is coupled to a negative input of the right amplifier 10 through an input capacitor C1 and a resistor R1. The negative input of the right amplifier 10 is coupled to an output of the right amplifier 10 through a resistor R3. A right output signal passes through an output capacitor C3. The right input line is also coupled to a positive input of the left amplifier 12 through the right automatic level control 16.

It is preferably to insert a potentiometer P2 before an input of the right automatic level control 16 and the input capacitor C1 to provide for tuning of a left audio surround field. It is also preferably to insert a right frequency pass filter 20 between an output of the right automatic level control 16 and the positive input of the left amplifier 12 to improve audio sound quality. The positive input of the left amplifier 12 is pulled-up with pull-up resistors R5 and R6.

A left input line is coupled to a negative input of the left amplifier 12 through an input capacitor C2 and a resistor R2. The negative input of the left amplifier 12 is coupled to an output of the left amplifier 12 through a resistor R4. A left output signal passes through an output capacitor C4. The left input line is also coupled to a positive input of the right amplifier 10 through the left automatic level control 14. It is preferably to insert a potentiometer P1 between an input of the left automatic level control 14 and the input capacitor C2 to provide for tuning of a right audio surround field. It is also preferably to insert a left frequency pass filter 18 between an output of the left automatic level control 14 and the positive input of the right amplifier 10 to improve audio sound quality. The positive input of the right amplifier 12 is pulled-up with pull-up resistors R7 and R8.

The following component values are given by way of example and not by way of limitation. Satisfactory results have been found when input capacitors C1 and C2 have a value of 10 microfarads; resistors R1 and R2 have a value of 4.7 kilohms; and resistors R3 and R4 have a value of 30 kilohms. It is preferably to use the first and second amplifiers contained in a National Semiconductor LM4808 chip and the first and second automatic level control circuits in a Maxim MAX9756 chip. The potentiometers P1 and P2 have a preferably value of between 5-10 kilohms. The first and second frequency pass filters preferably allow signals above 100 hertz to pass, but other values may also be used. The pull-up resistors R5-R8 all have a preferable value of 100 kilohms. Output capacitors C3, C4 have a preferably value of at least 100 microfarads.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A surround sound circuit comprising:

a first amplifier and a second amplifier;

a first automatic level control and a second automatic level control;

a first input line being coupled to said first amplifier and a second input line being coupled to said second amplifier;

said first input line being connected to an input of said first automatic level control, said second input line being connected to an input of said second automatic level control;

an output of said first automatic level control being connected to said second amplifier, an output of said second automatic level control being connected to said first amplifier.

2. The surround sound circuit of claim 1, further comprising:

said first input line being coupled to said first amplifier with a first input capacitor, said second input line being coupled to said second amplifier with a second input capacitor.

3. The surround sound circuit of claim 2, further comprising:

a negative input of said first amplifier being coupled to an output of said first amplifier with a first resistor, a negative input of said second amplifier being coupled to an output of said second amplifier with a second resistor.

4. The surround sound circuit of claim 1, further comprising:

a first potentiometer being coupled to said first input line and connected to said input of said first automatic level control, a second potentiometer being coupled to said second input line and connected to said input of said second automatic level control.

5. The surround sound circuit of claim 1, further comprising:

a first frequency pass filter being connected to said output of said first automatic level control, a second frequency pass filter being connected to said output of said second automatic level control.

6. The surround sound circuit of claim 1, further comprising:

a first output capacitor being connected to an output of said first amplifier, a second output capacitor being connected to an output of said second amplifier.

7. The surround sound circuit of claim 1, further comprising:

said first input line being coupled to a negative input of said first amplifier, said second input line being coupled to a negative input of said second amplifier.

8. A surround sound circuit comprising:

a first amplifier and a second amplifier;

a first automatic level control and a second automatic level control;

a first input line being coupled to a negative input of said first amplifier and a second input line being coupled to a negative input of said second amplifier;

said first input line being connected to an input of said first automatic level control, said second input line being connected to an input of said second automatic level control;

an output of said first automatic level control being connected to a positive input of said second amplifier, an output of said second automatic level control being connected to a positive input of said first amplifier.

9. The surround sound circuit of claim 8, further comprising:

said first input line being coupled to said negative input of said first amplifier with a first input capacitor, said second input line being coupled to said negative input of said second amplifier with a second input capacitor.

10. The surround sound circuit of claim 9, further comprising:

said negative input of said first amplifier being coupled to an output of said first amplifier with a first resistor, said negative input of said second amplifier being coupled to an output of said second amplifier with a second resistor.

11. The surround sound circuit of claim 8, further comprising:

a first potentiometer being coupled to said first input line and connected to said input of said first automatic level control, a second potentiometer being coupled to said second input line and connected to said input of said second automatic level control.

12. The surround sound circuit of claim 8, further comprising:

a first frequency pass filter being connected to said output of said first automatic level control, a second frequency pass filter being connected to said output of said second automatic level control.

13. The surround sound circuit of claim 8, further comprising:

a first output capacitor being connected to an output of said first amplifier, a second output capacitor being connected to an output of said second amplifier.

* * * * *

UNITED STATES PATENT AND TRADEMARK OFFICE

CERTIFICATE OF CORRECTION

PATENT NO. : 8,121,318 B1
APPLICATION NO. : 12/117154
DATED : February 21, 2012
INVENTOR(S) : Paul R. Ambourn and Earl Jay Slaton It is certified that error appears in the above-identified patent and that said Letters Patent is hereby corrected as shown below:

Title Page, Item (76) Inventors, the name of the second inventor should read --Earl Jay Slaton--

Signed and Sealed this
Third Day of April, 2012

David J. Kappos

David J. Kappos
*Director of the United States Patent and Trademark Office*